United States Patent [19]

Dorsey

[11] Patent Number: 4,614,089

[45] Date of Patent: Sep. 30, 1986

[54] CONTROLLED REFRIGERATION SYSTEM

[75] Inventor: James M. Dorsey, Baltimore, Md.

[73] Assignee: General Services Engineering, Inc., Baltimore, Md.

[21] Appl. No.: 713,617

[22] Filed: Mar. 19, 1985

[51] Int. Cl.[4] ..... F25B 1/00

[52] U.S. Cl. ..... 62/158; 62/228.3; 62/228.4; 62/510; 236/1 EA

[58] Field of Search ..... 62/175, 510, 157, 158, 62/231, 228.3, 228.5, 196.2; 236/1 EA

[56] References Cited

U.S. PATENT DOCUMENTS

| | | | |
|---|---|---|---|
| 3,599,006 | 8/1971 | Harris | 62/158 X |
| 4,272,012 | 6/1981 | Molnar et al. | 236/1 EA |
| 4,483,151 | 11/1984 | Fujioka et al. | 62/157 |
| 4,537,038 | 8/1985 | Alsenz et al. | 62/158 |

*Primary Examiner*—Harry Tanner

*Attorney, Agent, or Firm*—Leonard Bloom

[57] ABSTRACT

A controlled refrigeration system includes a plurality of refrigerant compressors fed from a common suction manifold (line). Each compressor is associated with a respective controller. The individual controllers are set to effect the cutting in of its associated compressor at different levels of input voltage from a pressure transducer using digital techniques. The individual controllers each produce respective digital cut-in, cut-out, down-time delay and power-up delay signals. Respective logic circuitry is provided within each controller for producing control outputs which effect the energization and deenergization of the individual controllers. The compressors are turned on and off in sequence as the demand for compression respectively increases and decreases. The power-up delay period differs for each controller so that no more than one is energized at a given time when the system comes on line after a power failure or extended period of shut down.

6 Claims, 8 Drawing Figures

CONTROLLED REFRIGERATION SYSTEM

BACKGROUND OF THE INVENTION

This invention relates to controlling the operation of refrigeration systems which contain multiple compressors. More particularly, the present invention is concerned with refrigeration systems of the type having multiple compressors fed from a common suction manifold and which deliver refrigerant gas under pressure to a common head pressure manifold.

It is known from U.S. Pat. No. 3,599,006 to John L. Harris granted Aug. 10, 1971 and entitled "Condition Control Device and System" to provide multiple compressors in a refrigeration system. The system is arranged so that the compressors are started in sequence, allowing each compressor to come up to speed before the next compressor is started. The system also interposes a delay between the stopping and restarting of the respective compressors so that a compressor is not started under heavy load. The system is essentially an electromechanical system responsive to analog signals and completely analog in nature.

It is known from U.S. Pat. No. 4,128,854 to Robert T. Ruminsky issued Dec. 5, 1978 and entitled "Compressor Minimum Off-time System" to place a current transformer in a circuit which controls the switching of a compressor. The current transformer, in turn, provides a control signal to a minimum off-time circuit. The purpose of the delay effected by the off-time circuit is to prevent start-up under heavy load. Like the system disclosed in Harris, supra, the system is analog in nature and is responsive to analog signals.

It is known from U.S. Pat. No. 3,636,369 to Donald G. Harter, granted on Jan. 18, 1972 and entitled "Refrigerant Compressor Control-relay to Control Two Time Delays" to provide a refrigerant compressor with a relay arrangement which controls two time delays. One time delay keeps the compressor deenergized at least for a predetermined period after each stop action. The other time delay keeps the compressor energized for at least a predetermined period after each start action.

It is known from U.S. Pat. No. 4,033,738 to Carl R. Metrola et al., granted on July 5, 1977 and entitled "Heat Pump System with Multi-stage Centrifugal Compressors" to arrange multistage compressors in series. The start of the second compressor is delayed for a sufficiently long period to enable the first compressor to reach its design speed.

The use of a microprocessor and timed solid state logic circuitry to control automatically sequencing of compressors in a refrigeration system is disclosed in U.S. Pat. No. 4,152,902 granted May 8, 1979 to Lawrence E. Lush and entitled "Control for Refrigerator Compressors".

SUMMARY OF THE INVENTION

A principal object of the present invention is to provide a multiple compressor refrigeration system which is controlled by a single pressure transducer responsive to pressure in the suction manifold of the system.

Another object of the present invention is to provide a multiple compressor refrigeration system which is controlled by a single pressure transducer in the suction manifold of the system, time delays being provided using digital techniques.

The controlled refrigeration system of the present invention provides an electronic technique for controlling the operation of refrigeration systems containing multiple compressors. Multiple compressor gas input lines are connected to a common suction manifold and output lines to a common head pressure manifold. As more refrigeration is needed, suction pressure increases. One compressor controller is used with each compressor. Respective cut-in and cut-out points are set for each of the compressors in the system so that as suction pressure increases more of the compressors are turned on. As the suction pressure decreases, the respective compressors are respectively shut off, one at a time, until the system is stabilized. Each of the compressors which is shut off must satisfy a delay period set by respective digital input program (DIP) switches until it can be restarted. Until a "down time set" time delay has been satisfied, the turned-off compressor cannot be restarted.

Each compressor controller accepts an input voltage from the pressure transducer connected to the system suction manifold (line) as its control input. The individual controllers are set to effect the cutting in of its associated compressor at different levels of input voltage from the pressure transducer. A "zero" adjustment enables each of the controllers to account for the variation of output offset voltage between pressure transducers, and each of the controllers is "zeroed" at atmospheric pressure. A digital panel meter is desirably used to monitor samples of the cut-in and cut-out set points, the current, and the suction pressure. The cut-in and cut-out set points can also be adjusted to the desired levels by using the digital meter.

When the respective cut-in pressure level is exceeded for at least eight seconds, the associated compressor will be started. Whenever the suction pressure falls below the cut-out point for eight seconds, the associated compressor is turned off. The eight seconds is digitally controlled by the module design and is not externally adjustable.

Additionally, each of the controllers provide a respective separate delay which is triggered upon a "power-up". This time delay is independent of the "down-time set" delay, and, is similarly set by using respective digital input program (DIP) switches. As an example, when ten compressors are configured into one system, and a power interruption occurs, it is undesirable to have all ten compressors stop and restart together. The inrush starting current for ten compressors, or for that matter any plurality, could be so excessive that equipment damage may result. The "power-up set" function activates a delay which can be set individually, and thus differently, for each of the compressors. Upon the system start up, one compressor can be started, for example, every 30 seconds until all ten compressors, or fewer if the suction pressure desired is achieved, are back on line.

The present invention can be viewed as being in a compressor controller which includes means responsive to output from a pressure responsive transducer for providing a digital cut-in control signal. A source of clock pulses is provided. A counter which has an output terminal, includes a clock input terminal coupled to receive the clock pulses and an enabling input terminal coupled to receive the digital cut-in control signal. An AND gate having an output terminal is included, one of its input terminals being coupled to receive the digital cut-in control signal and its second input terminal being coupled to the output terminal of the counter. The digital output signal from the counter to the gate appears upon expiration of a predetermined count.

The present invention can be seen as being in a compressor controller which includes means responsive to output from a pressure responsive transducer for providing a digital cut-out control signal. A source of clock pulses is included. A counter having an output terminal is provided. The counter has a clock input terminal coupled to receive the clock pulses and an enabling input terminal coupled to receive the digital cut-out control signal. An AND gate having an output terminal is provided. One of its input terminals is coupled to receive the digital cut-out control signal and its second input terminal is coupled to the output terminal of the counter. A digital output signal from the counter to the gate appears upon expiration of a predetermined count.

From another viewpoint the present invention can be seen as being in a compressor controller which includes means responsive to output from a pressure responsive transducer for providing a digital cut-in control signal. Means responsive to output from the pressure responsive transducer is provided for providing a digital cut-out control signal. A source of clock pulses is included. An OR gate means is coupled to receive the digital cut-in signal and the digital cut-out signal for producing a digital data output signal upon the occurrence of either the digital cut-in signal or the digital cut-out signal. A counter having an output terminal is provided, its clock input terminal being coupled to receive the clock pulses and its enabling input terminal being coupled to receive the digital data output signal from said OR gate means. A first AND gate having an output terminal is included, one if its input terminals being coupled to receive the digital cut-in control signal and its second input terminal being coupled to the output terminal of the counter to receive a digital output signal therefrom which appears upon expiration of a predetermined count. A second AND gate having an output terminal is also provided, one of its input terminals being coupled to receive the digital cut-out control signal and its second input terminal being coupled to the output terminal of the counter to receive the digital output signal therefrom which appears upon expiration of a predetermined count.

In a different aspect the present invention can be seen as being in a compressor controller which includes means for generating a signal indicative of application of operating power to the controller. A source of clock pulses is included. A timer-counter having its clock input terminal coupled to receive the clock pulses is provided, its data input terminal being coupled to receive the signal indicative of application of operating power to the controller. Digital input programming means are coupled to the timer-counter for setting a count interval of the timer-counter, the timer-counter producing a digital output signal upon expiration of the count interval.

In yet another aspect the present invention can be viewed as being in a compressor controller which includes means for generating a digital signal indicative of its associated compressor being deenergized in response to a cut-off signal. A source of clock pulses is provided. A timer-counter has its clock input terminal coupled to receive the clock pulses and its data input terminal coupled to receive the digital signal indicative of the associated compressor being deenergized. Digital input programming means is coupled to the timer-counter for setting a count interval of the timer-counter, the timer-counter producing a digital output signal upon expiration of the count interval.

The present invention can also be viewed as being in a compressor controller which includes means for generating a signal indicative of application of operating power to the controller and means for generating a digital signal indicative of its associated compressor being deenergized in response to a cut-off signal. A source of clock pulses is provided. A first timer-counter has its clock input terminal coupled to receive the clock pulses and its data input terminal coupled to receive the signal indicative of application of operating power to the controller. First digital input programming means is coupled to the first timer-counter for setting a first count interval of the first timer-counter, the first timer-counter producing a digital output signal upon expiration of the first count interval. A second timer-counter has its clock input terminal coupled to receive the clock pulses and its data input terminal coupled to receive the digital signal indicative of the associated compressor being deenergized. Second digital input programming means is coupled to the second timer-counter, the second timer-counter producing a digital output signal upon expiration of the second count interval.

The invention is also seen as a controlled refrigeration system comprising at least one compressor controller. Transducer means are provided for developing a signal representing refrigerant pressure. Means responsive to the signal representing refrigerant pressure are provided for developing a first digital, cut-in signal. Other means responsive to the signal representing refrigerant pressure are provided for developing a second digital, cut-out signal. Means responsive to application of power to the controller is provided for developing a third digital signal indicative of expiration of a predetermined power-up delay period. Means responsive to a signal representing deenergization of a refrigerant compressor is provided for developing a fourth digital signal indicative of expiration of a predetermined down-time delay. Circuit means are included for developing a compressor-controlling output in response to the third digital signal, to the fourth digital signal and to one or the other of the first digital signal and the second digital signal. The associated compressor is deenergized whenever the second, third and fourth digital signals are present, and energized when the first, third and fourth digital signals are present.

The invention is also seen as a controlled refrigeration system comprising a plurality of compressor controllers. Transducer means are provided for developing a signal representing refrigerant pressure. Each controller includes means responsive to the signal representing refrigerant pressure for developing a respective, different first digital, cut-in signal. Each controller includes means responsive to the signal representing refrigerant pressure for developing a respective, different second digital, cut-out signal. Each controller includes means responsive to applications of power to it for developing a respective third, digital signal indicative of expiration of a respective different, predetermined power-up delay period. Each controller is also provided with respective means responsive to a signal representing deenergization of a refrigerant compressor for developing a respective fourth, digital signal indicative of expiration of a predetermined down-time delay. Circuit means are provided in each controller for developing a respective compressor-controlling output in response to the respective third digital signal, to the respective fourth digital signal and to one or the other of the respective first digital signal and the respective second digital signal.

DETAILED DESCRIPTION OF THE PREFERRED EMBODIMENT

Figure 1:
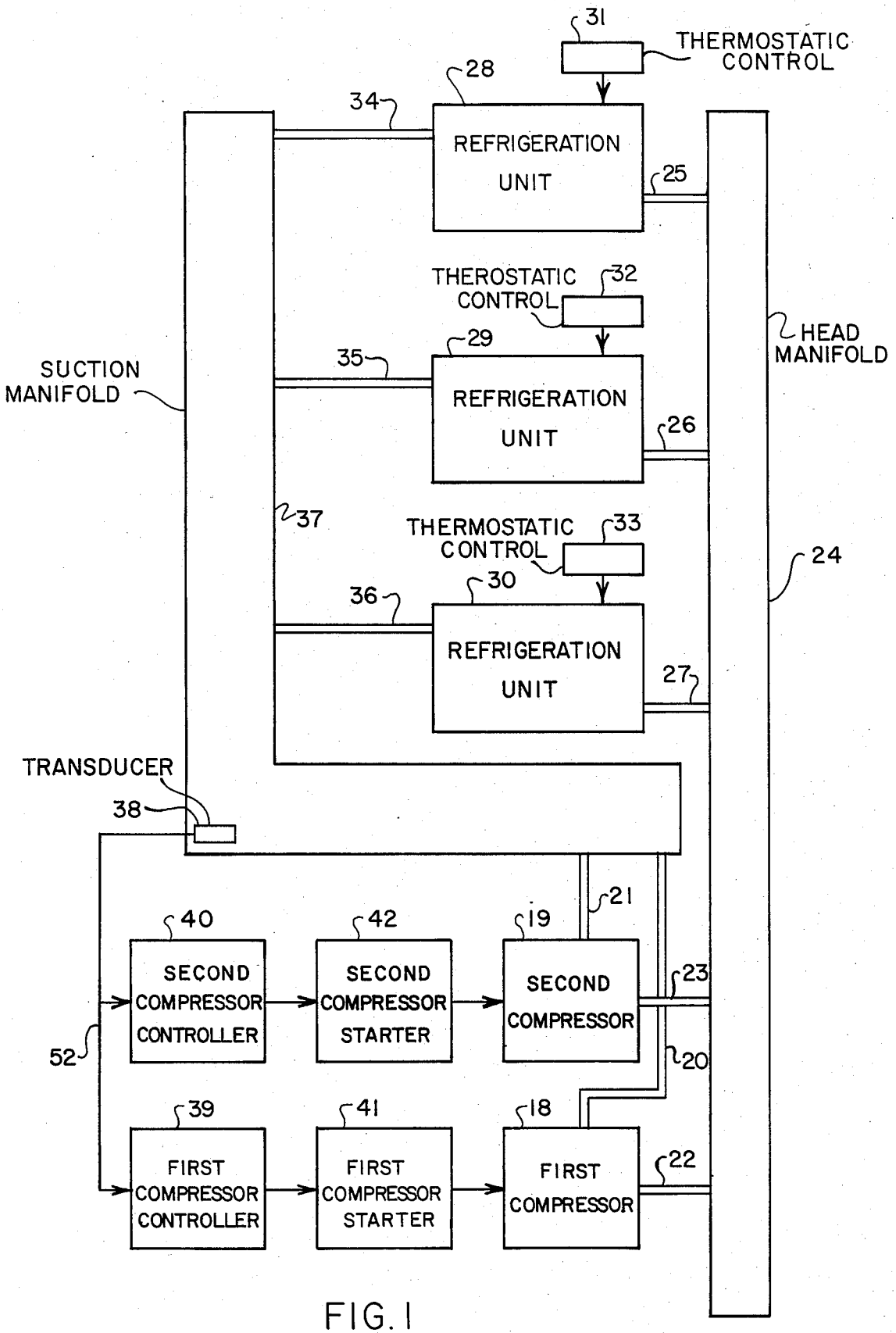
FIG. 1 is a diagramatic illustration of a controlled refrigeration system having multiple compressors in accordance with an exemplary, illustrative embodiment of the present invention.

As shown in FIG. 1, the illustrative embodiment of a controlled refrigeration system of the present invention includes a plurality of refrigerant compressors, a first compressor 18 and a second compressor 19 being shown by way of example. It is to be understood that more than two refrigerant compressors could be used, systems involving ten compressors are not uncommon. Each of the refrigerant compressors 18 and 19 is of conventional construction and nature. The compressors 18 and 19 are connected to respective refrigerant supply lines 20 and 21, and when energized, effect compression of the gaseous refrigerant supplied via these lines. The compressed gaseous refrigerant is fed from the respective compressors 18 and 19 to a single head manifold 24, via respective lines 22 and 23. The gaseous refrigerant is held in the head manifold 24, under pressure, ready to be supplied, on a demand basis, to any one of a plurality of refrigeration units, three such units 28–30 being shown by way of example. The units 28–30 may be, for example, frozen food or meat lockers, frozen food or meat display cases, milk display cases, soft drink dispensers, cooled food storage enclosures, display cases and the like. The illustrated system is, in a practical sense, very useful to operators of retail food stores and the like, but is not limited to such uses. The system can also be used as part of a building air conditioning arrangement.

A plurality of refrigerant output lines 25, 26 and 27 are in fluid communication with the head manifold 24, each output line receiving the pressurized refrigerant therefrom. As illustrated, the respective refrigerant output lines 25–27 are respectively connected to the refrigerating units 28–30 to supply, on demand, the pressured gaseous refrigerant thereto. The units 28–30 are conventional refrigerating units having coils therein within which the gaseous refrigerant expands and passes through, absorbing heat and thereby reducing the respective temperatures within the units 28–30. The units 28–30 may include conventional radiators and fans, and are provided with respective conventional user-settable thermostatic controls 31–33 which control the initiation of flow of the pressurized refrigerant gas, via conventional valves (not shown), into the respective refrigeration units 28–30 and the interruption of flow so as to maintain the temperatures within the respective units 28–30 between predetermined upper and lower limits defining respective temperature ranges determined by the user.

Respective expended refrigerant output lines 34–36 are provided from each of the refrigeration units 28–30 to a single suction manifold 37. A single pressure-to-voltage transducer 38 operatively arranged to respond to the pressure with the suction manifold 37 is provided, the transducer 38 having an output voltage signal which varies directly with the absolute pressure within the suction manifold. In other words, the less the magnitude of the negative pressure (suction) within the manifold 37, the greater the output signal voltage from the pressure-to-voltage transducer 38. The transducer 38 may be removeably placed within the suction manifold 37 or be removeably placed in a wall thereof or be otherwise in fluid communication with the suction manifold. The expended, low pressure gaseous refrigerant within the suction manifold 37 may be supplied to one or the other or both of the refrigerant compressors 18 and 19 via the supply lines 20 and 21 and respective valves (not shown) provided either of the compressors 18 and 19 is energized.

The output voltage signal from the pressure-to-voltage transducer 38 is fed as respective inputs to a plurality of compressor controllers, a first compressor controller 39 and a second compressor controller 40 being illustrated, it being understood that the number controllers provided corresponds to the number of compressors. One individual controller is provided for each compressor. As is made clear below in conjunction with the description of FIGS. 2, 3A and 3B, the respective controllers 39 and 40 are respectively set to respond to different magnitudes of the voltage output signal from the transducer 38.

Each of the compressor controllers 39 and 40 produces under predetermined conditions, respective control output signals which, when present, effect the activation of a first compressor starter 41 or a second compressor starter 42, as the illustrated cases may be. When energized, the respective starters 41 and 42 cause the respective compressors 18 and 19 to start and run, drawing gaseous refrigerant at low pressure from the suction manifold 37, compressing same and delevering the thus compressed gaseous refrigerant to the head manifold 24. Because the system is a closed system, a reduction in the suction or negative pressure (an increase in pressure) within the suction manifold is indicative of a lower pressure in the head manifold 24 and less gaseous refrigerant therein.

Figure 2:
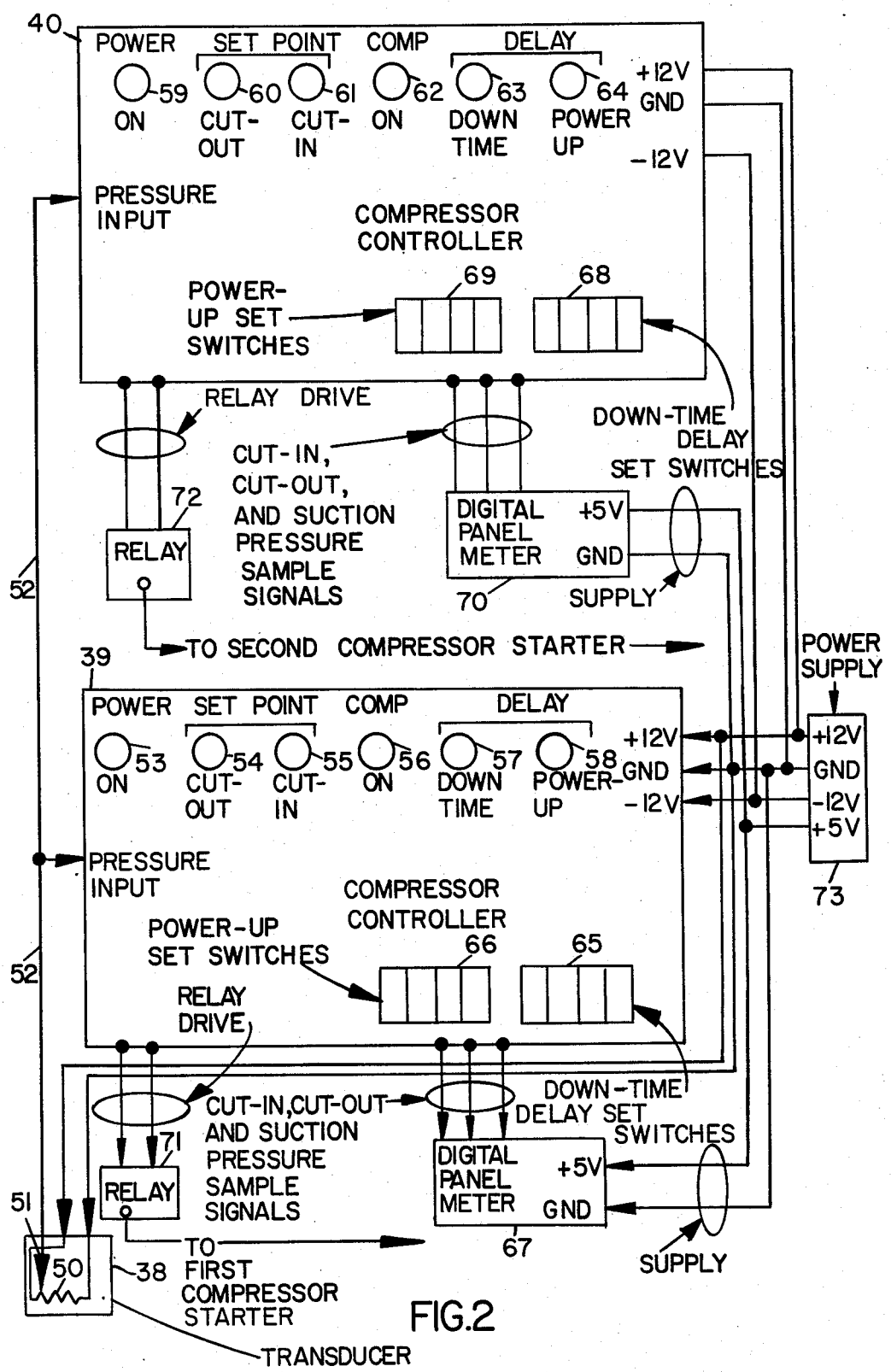
FIG. 2 is a simplified block diagram of portions of the refrigeration system illustrated in FIG. 1, electrical input and output connections to the compressor controllers being shown in detail.

The illustrated preferred embodiment of the controlled refrigeration system of the present invention, as shown in FIG. 1 is, in a realized exemplary embodiment, provided with a number of electrical input and output connections to and from the first controller 39 and similarly to and from the second controller 40, as illustrated in FIG. 2. Of course, it is to be understood that while only two compressor controllers are illustrated any number above one could be provided in accordance with the present invention, systems involving ten compressors not being unusual.

Figure 4:
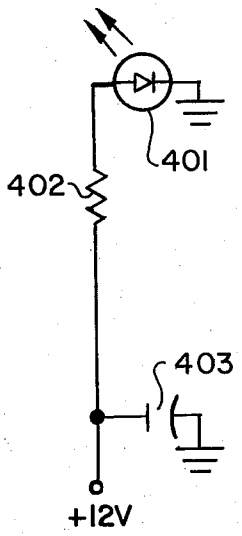
FIG. 4 is a schematic diagram of a power ON indicating circuit useful in providing a visible signal indicative of application of +12 volts D.C. input to a respective compressor controller.

The first compressor controller 39 includes, on its front panel, a number of apertures 53–58 through which light from respective light-emitting-diodes (LED's) can be viewed. The LED which is to be viewed through the aperture 53, as will be made more clear below in the description of FIG. 4, is in a circuit which energizes this particular LED whenever +12 volts D.C. operating power is applied to the compressor controller 39. The test "POWER ON" appears on the panel in the vicinity of the aperture 53. The test "SET POINT" appears over the apertures 54 and 55, the test "CUT-IN" and "CUT-OUT" appearing respectively below these apertures. Respective LED's which are to be viewed through the respective apertures 54 and 55, are in respective circuits which respectively energize these particular LED's whenever, during the operation of the system, the controller 39 is being called upon respectively to turn off or to turn on its associated compressor 18 (FIG. 1). The LED to be viewed through the aperture 56 is arranged in a circuit which energizes it whenever the controller 39 keeps its associated compressor 18 (FIG. 1) energized. The text "COMP. ON" appears on the panel in the vicinity of the aperture 56, the LED which can be viewed through this aperture being energized whenever the first compressor 18 is running. The text "DELAY" appears above the apertures 57 and 58, the respective text "DOWN TIME" and "POWER UP" appearing beneath these respective apertures. Respective LED's to be viewed through the apertures 57 and 58 being in circuit with respective electronic circuitry, in the circuit illustrated in FIGS. 3A–3B, which respectively energize them whenever the down time delay and power up delay times are not satisfied. An operator or one placing the refrigeration system of the present invention in operation can monitor the operation of the compressor controller 39 by observing which ones of the LED's are energized at any given time by simply observing these LED's through the apertures 53–58 in the front panel of the compressor controller 39.

The front panel of the compressor controller 39 includes respective rectangular apertures 65 and 66 through which respective groups of four thumb switches extend. These respective thumb switches are provided to allow an installer or operator to select and to set the minimum down time delay and the respective power up delay time for the first compressor 18. The sequential turn on times thus may be selected by an installer or technician who is concerned with operating the refrigeration control system of the present invention.

In addition to a common system ground connection to supply power to the compressor controller 39, a power supply 73 includes three other output terminals, a +12 volts D.C. terminal, a −12 volts D.C. terminal and a +5 volts D.C. terminal, the voltage inputs to the first controller 39, as well as the ground connection, being provided by appropriate buses between the power supply 73 and the first controller. The +5 volts D.C. output of the power supply 73, as well as the common system ground connection thereto, are utilized to supply operating voltage to a digital panel meter 67 which receives its output from the first compressor controller 39 for the purpose of displaying CUT-IN, CUT-OUT and suction pressure sample signals, these signals being supplied to the panel meter via a multiposition selecting switch (not illustrated) which are used to adjust the controller 39 and ready it for operation.

The output control signal from the controller 39 is provided, as shown in FIG. 2, via a pair of output leads which energize a relay 71 which in turn is operatively arranged to supply an enabling signal to the first compressor starter 41 (FIG. 1).

The controlling pressure input signal to the controller 39, as illustrated in FIG. 2, is supplied via signal input bus 52 to which a D.C signal is applied from the potentiometer 50 which has its associated wiper 51 connected to the bus 52. The potentiometer 50 is operatively arranged to receive across its terminals, a +12 volts D.C. input from the power supply 73. The potentiometer 50 with its pressure-responsive associated wiper 51 constitutes the pressure-to-voltage transducer 38 which is, as shown in FIG. 1, positioned within the suction manifold 37 and is responsive to the pressure therein, the wiper 51 of the transducer 38 being positioned by an actuator, its position being determined by the actual pressure within the suction manifold 37.

A pressure input connection to the second compressor controller 40 is also supplied from the bus 52. The compressor controller 40 is internally constructed identically to the compressor controller 39 and receives its input power from the power supply 73 via three connections to the power supply, including a system ground connection, which correspond to those to the first compressor controller 39. The front panel of the compressor controller 40 is provided with a plurality of apertures 59–64, with their associated text, corresponding to the apertures 53–58 and associated text, which are on the front panel of the controller compressor 39. Similarly, the second controller compressor 40 is provided with two respective rectangular apertures 68 and 69 through which respective groups of four thumb switches appear, allowing an operator or technician setting up the system to set respectively the down time delay and the power up delay time for the compressor controller 40. Like the compressor controller 39, the compressor controller 40 is provided with a CUT-IN, CUT-OUT and suction pressure sample signal outputs which are supplied to its associated digital panel meter 70 selecting switch (not illustrated), and which receives its power input from the common system ground and the +5 volts D.C. input from the power supply 73. The output from the compressor controller 40 is supplied as a relay drive signal to a relay 72 which corresponds to the relay 71 associated with the compressor controller 39, the relay 72 being operatively arranged to energize the second compressor starter 42 (FIG. 1) which starts and supplies operating power to the second compressor 19 (FIG. 1). Six LED's are positioned respectively beneath the apertures 59–64 to provide visible indications of circuit conditions during operation.

Figure 3A:
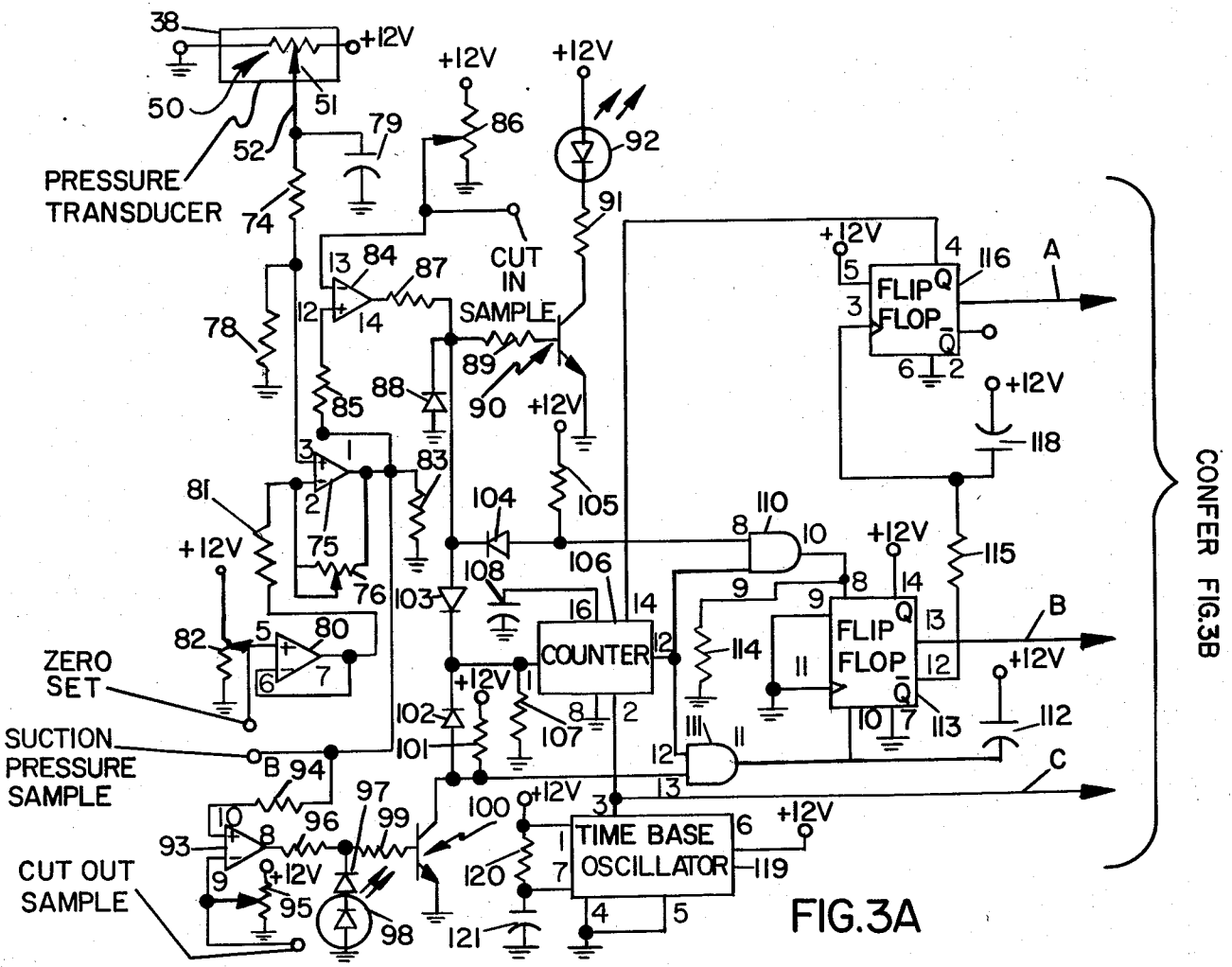
FIGS. 3A and 3B, taken together, constitute a detailed schematic diagram of a compressor controller suitable for use as each of the compressor controllers illustrated in FIGS. 1 and 2, the pressure transducer, which responds to the pressure in the suction manifold, being shown as well.
Figure 3B:
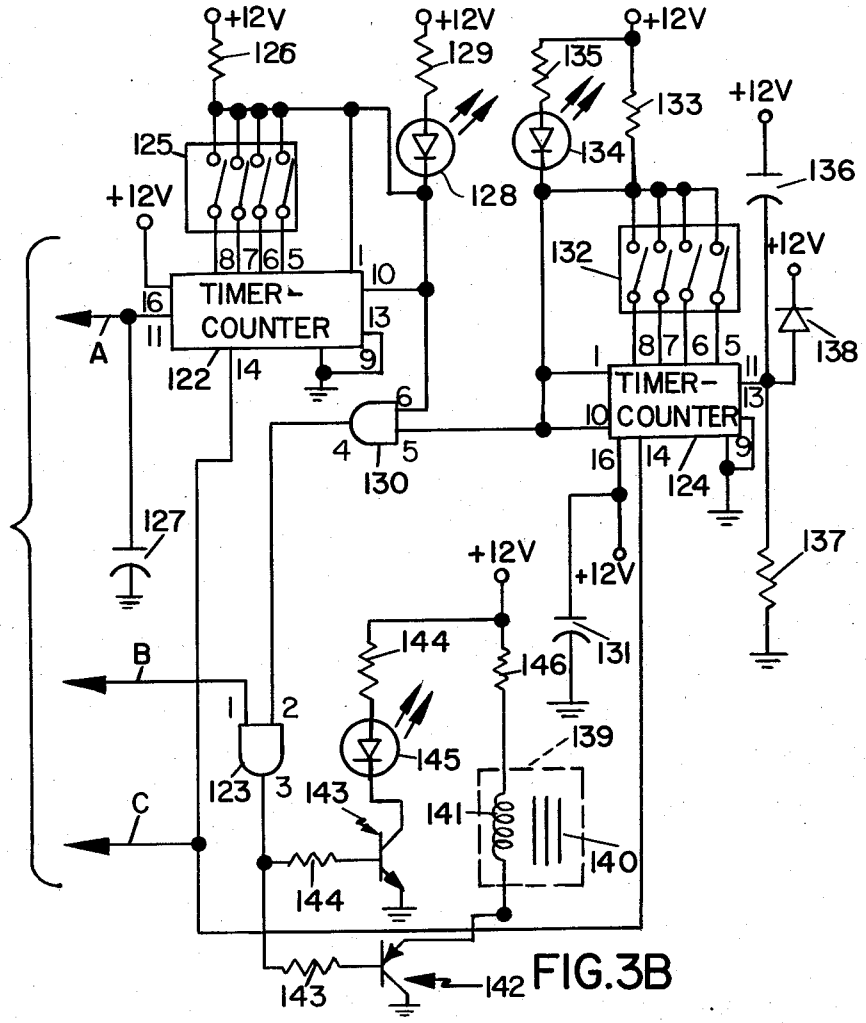

Each of the compressor controllers which are used in the controlled refrigeration system of the present invention, two such controllers being shown in FIGS. 1 and 2, utilizes identical circuitry, albeit certain adjustments therein differ so that each individual controller operates in response to different pressure inputs and also provide different power-on delay times and, if desired, different down-time delays. As illustrated in FIGS. 3A and 3B, the individual compressor controllers include components constituted by commercially available integrated circuits; in these instances, the pin numbers of the integrated circuits are shown. The individual compressor controllers include a resistor 74 connected in series between the bus 52 and a noninverting input terminal (pin 3) of an operational amplifier 75 which has its output terminal (pin 1) connected to its inverting input terminal (pin 2) via a variable resistance 76. The circuit point between the resistor 74 and the noninverting input terminal of the operational amplifier 75 is connected to system ground, via a resistor 78. The bus 52 is connected to system ground via a capacitor 79, which serves to filter out interference and smooths the pressure-related D.C. voltage signal which appears on the bus 52.

An operational amplifier 80, which has its output terminal (pin 7) connected to its inverting input terminal (pin 6) is provided with a noninverting input terminal (pin 5) connected to a wiper which forming part of a potentiometer defined by this wiper and a resistance 82, the resistance 82 being connected between the system ground and the +12 volts D.C. source. The output terminal of the operational amplifier 80, which functions as a unity gain buffer, is connected, via a resistor 81, to the inverting input terminal of the operational amplifier 75. The output terminal of the operational amplifier 75 is connected, via a resistance 83, to the circuit system ground and, via a resistor 85 to the noninverting input terminal (pin 12) of a comparator 84. The comparator 84 has its inverting input terminal (pin 13) connected to a wiper of a potentiometer defined by this this wiper and a resistance 86, the resistance 86 being connected between system ground and the +12 volts D.C. source. This particular wiper is also connected to a line on which appears a cut-in sample signal which appears on a test terminal and can be observed on associated digital panel meter 67 or 70 (FIG. 2), as the cases may be. The output terminal (pin 14) of the comparator 84 is connected to system ground, via the series connection of a resistor 87 and a diode 88, the anode of the diode 88 being connected to a system ground. The circuit point between the cathode of the diode 88 and one end of the resistor 87, which is not connected to the output terminal of the comparator 84, is connected, via a series connected resistor 89 to the base of an NPN transistor 90, the emitter of this transistor being connected to the system ground. The collector of the transistor 90 is connected to the +12 volts D.C. source via the series connection of a resistor 91 and a LED 92, the anode of which is connected to the +12 volts D.C. source. Whenever the compressor controller is in receipt of a signal calling for the cutting in of its associated compressor, the LED diode 92 emits light, by virtue of conduction of the transistor 90. This particular diode 92, which would be positioned beneath the aperture 55 (FIG. 2) or the aperture 61 (FIG. 2) as the cases may be so as to indicate to a viewer that the controller has determined that more compression using its associated compressor is required.

The output terminal of the comparator 84 is also connected, via the cathode-anode path of a diode 104 to a second input terminal (pin 8) of an AND circuit 110. The anode of the diode 104 is connected, via a resistor 105, to the +12 volts D.C. source. The cathodes of the diodes 88 and 104 are also connected, via the plate-cathode path of a diode 103 to an input terminal (pin 1) of a counter 106 which has this input terminal also connected to system ground, via a resistor 107. The cathode of a diode 102 is also connected to the cathode of the diode 103, its anode being connected to the collector of a NPN transistor 100, which has its emitter connected to a system ground. The anode of the diode 102 is also connected to the +12 volts D.C. source, via a series connected resistor 101.

The output terminal of the operational amplifier 75 is conductively connected to a monitoring terminal on which appears a D.C. signal indicative of suction pressure sample, this point also being connected to the noninverting input terminal (pin 10) of a comparator 93, via a resistor 94. The inverting input terminal (pin 9) of the comparator 93 is connected to the wiper of a potentiometer, defined by this wiper and a resistance 95 connected between system ground and the +12 volts D.C. source. This wiper is also connected to a monitoring terminal on which appears a signal corresponding to cut-out sample. The terminals on which the cut-out sample and suction pressure sample signals appear are, like the cut-in sample signal, fed via a conventional multi-position selector switch (not shown) to the digital panel meter 67 or 70 for monitoring by a user or installer. The output terminal (pin 8) of the comparator 93 is connected to the base of the transistor 100, via the series connection of a resistance 96 and a resistance 99. The circuit point between the resistor 96 and resistor 99 is connected to system ground, via a diode 97 and a LED 98, the anode of the LED 98 being connected to system ground.

A free-running, time base oscillator 119 which generates a one-half Hertz square wave output is provided to synchronize the circuitry of FIGS. 3A and 3B. Two terminals (pins 4 and 5) of the time base oscillator 119 are connected to system ground. Power is supplied to the time base oscillator 119 from the +12 volts D.C. supply. A resistor-capacitor network, consisting of the series connection of a resistor 120 and a capacitor 121 is provided, the resistor and capacitor being connected in the order named between the source of +12 volts D.C. and system ground. Two timing input connections are provided to the time base oscillator by conductive leads connected across the resistor 120. The timing output from the time base oscillator 119 is supplied to and appears on bus C and also is supplied as a clocking input to a terminal (pin 2) of the counter 106, via a connection from an output terminal (pin 3) of the counter 106.

A pair of AND gates 110 and 111 are provided, first input terminals (pins 9 and 12) to each of the AND gates 110 and 111 being conductively connected together and to an output terminal (pin 12) of the counter 106. The second terminal of the AND gate 110 is connected as noted above, via the plate cathode path of a diode 104 to a circuit point defined by the connection of ends of the resistors 87 and 89 to one another. The second input terminal (pin 13) of the AND gate 111 is conductively connected to the collector of the NPN transistor 100. The output terminal (pin 11) of the AND gate 111 is connected, via a capacitor 112, to the +12 volts D.C. source and, via a conductive connection to a data input terminal (pin 10) of a flip-flop 113. One terminal (pin 14) of the flip-flop 113 is connected to the source of +12 volts D.C. from which it is powered. A second data input terminal (pin 8) of the flip-flop 113 is connected to the output terminal of the AND gate 110. A further terminal (pin 9) and a clock input terminal (pin 11) of the flip-flop 113 are connected to system ground. The Q output terminal (pin 12) of the flip-flop 113 is connected, via a resistor 115, to the clocking input terminal (pin 3) of a flip-flop 116. This terminal is also connected, via a capacitor 118, to the source of +12 volts D.C.

The Q output terminal (pin 13) of the flip-flop 113 is connected to bus B which couples the Q output to a first input terminal (pin 1) of an AND gate 123. The Q output terminal (pin 2) from the flip-flop 116 is unconnected. The Q output terminal (pin 4) of the flip-flop 116 is connected to a bus A which provides an input to one input terminal (pin 11) of a timer-counter 122, the bus C providing a clocking input to the timer-counter 122 to supply to this timer-counter a clock pulses at the rate of one-half Hertz from the time base oscillator 119. A capacitor 127 is connected between system ground and the bus A. Power is supplied to the timer-counter 122 from the +12 volts D.C. source, which is connected to one terminal (pin 16) of the timer-counter. Two terminals (pins 9, 13) of the timer-counter 122 are connected system ground; a further terminal (pin 11) is connected, via a resistor 126 to the +12 volts D.C. source. Four other terminals (pins 5–8) of the timer-counter 122 are respectively connectable to the +12 volts D.C. source via four respective DIP switches referred to generally by the numeral 125 and constituting the down-time delay set switches 65 or 68 illustrated in FIG. 2. The output terminal of the timer-counter 122 is also connected to the +12 volts D.C. source via a LED 128 and a resistor 129 which is connected in series with the LED 128. The LED 128 is to be positioned beneath the aperture 57 or the aperture 63, shown in FIG. 2 and becomes deenergized to indicate that the down-time delay has expired and that particular compressor controller is available for work. The output from the timer-counter 122 is also connected to a first input terminal (pin 6) of an AND gate 130, which has its output terminal (pin 4) connected to the second input terminal (pin 2) of the AND gate 123.

The bus C is connected to an input terminal (pin 14) of a timer-counter 124 which is supplied power from the +12 volts D.C. source which is connected to a terminal (pin 16) of the timer-counter 124, this terminal also being connected to system ground via a capacitor 131. Two terminals (pins 9, 13) of the timer-counter 124 are connected to system ground, another terminal of this timer-counter being connected to the +12 volts D.C. source via the plate-cathode path of a diode 138. Output from the timer-counter 124 is supplied via two terminals (pins 1, 10) to a second input terminal (pin 5) of the AND gate 130. This connection is also connected to the +12 volts D.C. source via a resistor 133, which has connected in parallel with it a series connection consisting of a LED 134 and a resistor 135. Whenever the timer-counter 124 provides an output to the second input terminal of the AND gate 130 the LED 134 is deenergized, indicating that the power-up delay criteria for operating has been satisfied and the particular compressor with which the circuit is associated is ready and may be next turned on. The actual delay time is set by four DIP switches 132, which correspond to the power-up set switches 66 and power-up set switches 69 shown in FIG. 2. The timer-counter 124 includes a resistor-capacitor circuit composed of a resistor 137 and a capacitor 136 connected in series with one another between system ground and the +12 volts D.C. source.

The output terminal of the AND circuit 130 is connected to the second input terminal of the AND circuit 123, as indicated above. The output terminal (pin 3) of the AND circuit 123 is connected to the base of PNP power transistor 142 via resistor 143. The collector of the transistor 142 is connected to system ground, its emitter being connected to one end of a coil 141 which forms the energizing coil of solenoid 139 which includes an iron core 140 and contacts (not illustrated) through which current is to be supplied to the associated compressor starter. The other end of the coil 141 is connected to the +12 volts D.C. source, via a current-limiting resistor 146. Whenever a logic ONE signal appears at the output of the AND circuit 123, the transistor 142 becomes nonconductive, the solenoid 139 is deactivated, and current is supplied to the associated compressor starter via normally closed contacts (not illustrated) of the solenoid. These contacts close whenever the transistor becomes nonconductive.

The output from the AND circuit 123 is also supplied to the base of a NPN transistor 143, via a resistor 144. The emitter of the transistor 143 is connected to system ground, its collector being connected via the cathode-anode path of an LED 145 which is connected in series with a resistor 144 to the +12 volts D.C. source.

Before placing the refrigeration system of the present invention into operation, an installer or operator would first ready the system for operation by decoupling the transducer 38 from its fluid communication with the suction manifold 37, in the illustrated embodiment by taking it out of the suction manifold, and exposing it to the atmosphere, causing the wiper 51 to move to a position on the resistance forming part of the potentiometer 50 which would correspond electrically to atmospheric pressure. The relay 139 would be electrically removed from the system so as not to turn on or off the associated compressor during the adjustment or set up procedures.

The installer or operator would then adjust the wiper constituting the potentiometer which includes the resistance 82 until the output from the operational amplifier 75 becomes zero. As pointed out above, the operational amplifier 75 has, in most cases, been preadjusted by setting the wiper of variable resistance 76 to set the gain of the operational amplifier 75 so that it functions correctly for a particular transducer linear input, for example an input in which each volt represents a change of 10 p.s.i. It is to be appreciated that were one to have the circuit operate in conjunction with a transducer having a different linear relationship, the value of the resistance 76, and thus the gain of the operational amplifier 75, would be changed to translate the different input relationship between pressure and voltage so that its output characteristic would have a relationship reflecting the one volt to 10 p.s.i. Thus, different types of transducers could be selected without any other circuit adjustments or changes.

The operator or installer then undertakes to set the cut-out and cut-in points for the particular compressor which is to be controlled by the compressor controller which he is readying for operation. He adjusts the wiper of the potentiometer which includes the resistance 95 to a particular point, knowing the desired cut-out compression level and that the relationship between the pressure and voltage is a particular linear relationship, being, as noted above one volt to 10 p.s.i., while observing the digital panel meter which has been coupled, via its associated selecting switch, to the cut-out sample terminal. Similarly, the installer or operator knowing the particular cut-in compression level at which a particular compressor, which is to be associated with the controller which is being ready for operation, is to come on line sets the wiper of the potentiometer which includes resistance 86 so that a particular value of D.C. voltage appears on the wiper, one volt corresponding to 10 p.s.i., again while observing the digital panel meter which has been coupled to the cut-in sample terminal via the selecting switch.

Next the installer or operator would, according to his instructions, set the four down-time DIP switches 125 associated with the timer-counter 122 to a particular value, depending on the down time period desired for the particular compressor controller being readied for service. As pointed out above, each of the four DIP switches 125 is associated with a particular delay, for example, four minutes, two minutes, one minute and one-half minute. If all of these switches are on, a total down-time delay of seven and one-half minutes would be provided. If only the right-most switch were closed, a minimum of one-half minute delay would be provided. Each of the compressor controllers could be set to have differing down time delays or be all identical. Of course, in some instances, for example when all of the compressor controllers in service or any two of them are set to cut out their associated compressors at the same cut-off point, it would be desirable to assure that they would not re-start at the same time; thus, in these instances the down-time delays would selected to be different in length. The installer or operator would similarly set the DIP switches 132 associated with the timer-counter 124 to a preselected power-up delay as planned, each compressor controller being provided with a different power-up delay time period to assure that the compressors would be energized sequentially when power is applied to the system subsequent to a power loss or a long-term user initiated de-energization of the system.

The installer or operator would then reestablish fluid communication between the transducer 38 and the suction manifold 37, in the illustrative embodiment by placing the transducer 38 within or in a wall of the suction manifold, and connect the relay 139 in circuit. The emitter-collector path of the transistor 142 would conduct, current would flow in the winding 141 and the contacts (not shown) associated with the relay would remain open. The associated compressor would be unenergized.

The same adjustments would be made in the circuits of the remainder of the plurality of the compressor controllers, placing the entire controlled refrigeration system in a condition for effectively controlling the operation of the plurality of compressors and providing refrigerant to the plurality of refrigeration units.

For purposes of discussion, it to be assumed that the pressure and temperature relationships existing do not require any of the compressors to be energized. The timer-counter 122 and the timer-counter 124 are in a timed out state. Upon application of power to the individual compressor controllers, the +12 volts D.C. power is applied to the circuit of FIG. 4, current flows through the LED 401, which is positioned beneath either aperture 53 (FIG. 2) indicating that power has been applied to the associated controller. The application of +12 volts D.C. to the circuit, which includes the RC circuit composed of the resistor 137 and capacitor 136, results in the production of a negative going edge trigger to the data input terminal of the power-up timer-counter 124 which is supplied with a series of clock pulses at the rate of one-half Hertz from the time base oscillator 119 to its clock input terminal. Upon receipt of the enabling signal, resulting from the negative going edge of the trigger pulse, the timer-counter 124 starts to count producing on its output terminal a ONE signal after the expiration of a predetermined time period as set by the DIP switches 132. As a result, the ONE signal appears on the first input of the AND gate 130 as well as on the cathode of the LED 134 causing this LED to cease conducting, causing light to disappear from beneath the aperture 58 (FIG. 2) or the aperture 64 (FIG. 2) in the corresponding compressor controller, as an indication that the power-up delay time has expired and the particular compressor controller may respond to calls for more compression.

The pressure within the suction manifold 37 causes the wiper 51 of the transducer 38 to move in proportion to the pressure. As the pressure increases, the voltage operational amplifier 75 translates the voltage so that a change of one volt D.C. corresponds to a pressure change of 10 p.s.i. The thus translated voltage appears at the noninverting input of the comparator 84 and continues to change until it equals the voltage supplied to its inverting input terminal from the wiper associated with the resistance 86. When the two inputs to the comparator 84 are equal, the output of the comparator 84 changes from ZERO to ONE. The appearance the ONE signal drives the transistor 90 into conduction, causing current to flow through LED 92 which is positioned beneath the aperture 55 (FIG. 2) or the aperture 61 (FIG. 2) as an indication that the cut in set point for the particular compressor which is to be energized has been reached. As yet the associated compressor is not turned on. The ONE signal from the comparator 87 is applied to the first input of the AND gate 110, via the diode 104. Simultaneously the ONE output from the comparator 84 is applied to the enabling input of the counter 106, which has been previously re-set, to start the counter 106 counting at the frequency of one-half Hertz, clock pulses being provided from the time base oscillator 119. After the expiration of eight seconds, a ONE signal appears on the output terminal of the counter 106, this signal being applied to the second input of the AND gate 110 which then, because of the already present ONE signal on its first input terminal responds, a ONE signal appearing on its output terminal resulting in the setting of the flip-flop 113 in a condition in which a ONE signal appears on its Q output terminal, this ONE signal being supplied to the first input terminal of the AND gate 123.

Since the power-up timer-counter 124 has run down, and the minimum down-time timer-counter 122 has run down, respective ONE signals appear on the first and second input terminals of the AND gate 130, resulting in a ONE signal appearing on its output terminal and being applied to the second input terminal of the AND gate 123. As a result, a ONE signal appears on the output terminal of the AND gate 123, resulting in the transistor 143 conducting, its emitter-collector current flowing through the LED 145 signaling that the compressor is on, the LED being positioned beneath the aperture 56 (FIG. 2) or the aperture 62 (FIG. 2). The compressor is actually turned on by action of the normally closed contacts (not illustrated) of the relay 139, which close when current to the winding 141 of the relay 138 is interrupted. Current through the winding 141 is interrupted whenever a ONE signal appears on the base of the transistor 142 from the AND gate 123. The compressor continues to operate, removing refrigerant from the suction manifold 37, compressing it and passing it on to the head manifold 24, with result that the pressure within the suction manifold 37 drops, corresponding voltage change takes place on the wiper 51 of the transducer 38. At sometime the pressure in the suction manifold 37 drops sufficiently to turn the comparator 84 off, that is reestablishing a ZERO signal on its output terminal. The associated compressor continues to run until the pressure within the suction manifold 37 drops still lower, a still lower voltage appears on the wiper 51, which voltage is translated by the operational amplifier 75 is fed to the noninverting input of the comparator 93 which has had on its output terminal a ONE signal until the voltage thereat corresponds to the voltage applied to its inverting input terminal, resulting in the appearance of a ZERO signal on its output terminal. As a result, the LED 98 is turned on, indicating that the cut-out set point has been reached, this particular diode being positioned beneath either the aperture 54 (FIG. 2) or the aperture 60 (FIG. 2). The ZERO signal from the comparator 93 is also applied to the base of the transistor 100, which ceases to conduct, placing a ONE signal on the first input terminal on the AND gate 111. This particular ONE signal is also applied to the enabling input of the counter 106, via the diode 102. The counter 106 (previously reset internally), again starts counting at the frequency one-half Hertz provided from the time base oscillator 119. Upon the expiration of an eight second interval, a ONE signal again appears on the output terminal of the counter 106 and is applied to the second input terminal AND gate 111, causing the flip-flop 113 to be reset to ZERO. As a result, the ONE signal which previously had been applied to the first input terminal of the AND gate 123 is removed. The transistor 143 becomes nonconductive and the LED 145 turns off. Simultaneously the transistor 143 becomes conductive, the relay 139 is again energized, resulting in the turn off of the associated compressor. Simultaneously the $\overline{Q}$ output from the flip-flop 113 becomes ONE resetting the flip-flop 116 which triggers the timer-counter 122, its output which had been ONE becomes ZERO, causing the AND gate 130 to change its output, thereby removing the ONE signal input to the second input terminal of the AND gate 123. This situation prevails preventing turn-on of the compressor until the timer-counter 122 runs down, the delay interval being determined by the setting of the DIP switch 125. It will be appreciated that the corresponding compressor cannot be turned on until the delay provided by the timer-counter 122 is satisfied upon expiration of its counting interval. At which time a ONE output signal is again provided from the output terminal of the timer counter 122 again placing a ONE signal on the second input terminal of the AND gate 130 which reestablishes the ONE signal on the second input of the AND gate 123 so that it will change its output from a ZERO to ONE when a further ONE signal is applied to its other input terminal. After the expiration of a further interval of one second from the time the output terminal of the counter 106 is supplied to the second inputs of the AND gates 110 and 111, the counter 106 produces another ONE signal from a second output terminal which is supplied as a reset signal to the flip-flop 116, again readying the flip-flop 116 for responding to a further signal from the flip flop 113.

As shown in FIG. 4, a circuit is illustrated for energizing an LED 401, which is to be viewed through the aperture 53 (FIG. 2) or the aperture 59 (FIG. 2), as an indicator that the respective compressor controller has been turned on. The circuit includes a system ground connection to the cathode of the LED 401, its anode being connected to the +12 volts D.C. supply via a series resistor 402. A capacitor 403 is connected from the +12 volts D.C. terminal to system ground.

Figure 5:
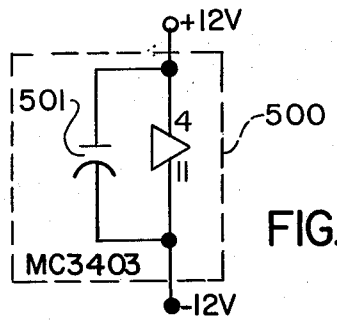
FIGS. 5, 6, and 7 are respective wiring diagrams showing pin connection numerals for particular commercially available integrated circuits which can be used for certain circuit components in the circuit of FIGS. 3A and 3B.

The buffer amplifier 80, the operational amplifier 75, the comparator 93 and the comparator 84 are constituted by respective one-fourths of a commercially available integrated circuit 500 (FIG. 5) identified by the designation MC 3403 and available from Motorola. This integrated circuit is supplied with power via pin connections 4 and 11, as illustrated in FIG. 5, a 0.1 μf capacitor being connected across these pins.

The timer-counter 122 and the timer-counter 124 are constituted by two identical commercially available integrated circuits, the integrated circuit being identified by the designation ICM 7240 and obtainable from Intersil. The flip-flop circuits 113 and 116 are provided by a commercially available integrated circuit identified by the designation MC 14013 and obtainable from Motorola.

Figure 6:
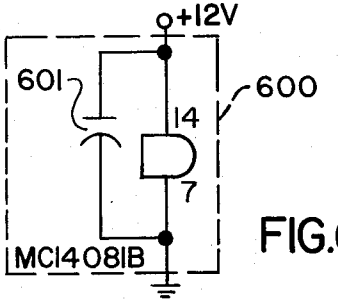

The AND gates 110 and 111 are formed by portions of a commercially available integrated circuit identified by the designation MC 14081B, which can be obtained from Motorola. In FIG. 6, this particular integrated circuit is shown as component 600, a 0.1 μf capacitor 601 being connected across its pins 7 and 14 which are respectively connected to system ground and the +12 volts D.C. source.

Figure 7:
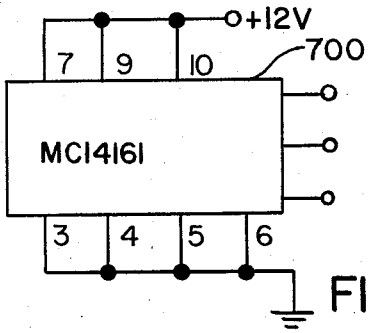

The counter 106 is constituted by a commercially available integrated circuit 700 (FIG. 7) identified by the designation MC 14161 and obtainable from Motorola. This particular integrated circuit is supplied with system ground connections and connections to the +12 volts D.C. source via given pins, as illustrated in FIG. 7.

The timer base oscillator 119 is constituted by a commercially available integrated circuit from Intersil and identified by the designation ICM 7242.

The foregoing detailed description and accompanying drawings have been set out by way of example, not by way of limitation. It is to be appreciated that numerous other embodiments and variants are possible, without departing from the spirit and scope of the present invention, its scope being defined by the appended claims.

What is claimed is:

1. A controlled refrigeration system comprising at least one compressor controller, transducer means for developing a signal representing refrigerant pressure, means responsive to the signal representing refrigerant pressure for developing a first digital, cut-in signal, means responsive to the signal representing refrigerant pressure for developing a second digital, cut-out signal, means responsive to application of power to said controller for developing a third digital signal indicative of expiration of a predetermined power-up delay period, means responsive to a signal representing deenergization of a refrigerant compressor for developing a fourth digital signal indicative of expiration of a predetermined down-time delay, and circuit means for developing a compressor-energizing control output in response to contemporaneous presence of the third digital signal, the fourth digital signal and the first digital signal, and for developing a compressor-deenergizing control output in response to contemporaneous presence of the third digital, the fourth digital signal and the second digital signal, wherein said circiut means for developing the compressor-energizing and compressor-deenergizing control outputs comprises logic circuit means, wherein said logic circuit means comprises a first AND gate having an output terminal, its two input terminals being coupled respectively to receive the third digital signal and the fourth digital signal and a second AND gate having an output terminal, its first input terminal being coupled to receive a digital signal from said output terminal of said first AND gate, including a source of clock pulses; and OR gate means coupled to receive the first digital, cut-in signal and the second digital, cut-out signal for producing a digital data output signal upon the occurrence of either the digital, cut-in signal or the digital, cut-out signal; a counter having an output terminal, a clock input terminal coupled to receive the clock pulses and an enabling input terminal coupled to receive the digital data output signal from said OR gate means; a further AND gate having an output terminal, one of its input terminals being coupled to receive the first digital, cut-in control signal and its second input terminal being coupled to said output terminal of said counter to receive a digital output signal therefrom which appears upon expiration of a predetermined count; and an additional AND gate having an output terminal, one of its input terminals being coupled to receive the second digital, cut-out control signal and its second input terminal being coupled to said output terminal of said counter to receive the digital output signal therefrom which appears upon expiration of a predetermined count.

2. The controlled refrigeration system according to claim 1, including a flip-flop circuit having one of its input terminals coupled to said output terminal of said further AND gate and responsive to a digital signal therefrom for setting said flip-flop circuit in a first condition, said flip-flop circuit having a second input terminal coupled to said output terminal of said additional AND gate and responsive to a digital signal therefrom for resetting said flip-flop circuit to a second condition, and wherein a second input terminal of said second AND gate os coupled to an outlet terminal of said flip-flop.

3. The controlled refrigeration system according to claim 2, wherein said flip-flop circuit has a Q output terminal and a output terminal.

4. A controlled refrigeration system comprising a plurality of compressor controllers, transducer means for developing a signal representing refrigerant pressure; and wherein each controller includes respective means responsive to the signal representing refrigerant pressure for developing a respective first digital, cut-in signal, respective means responsive to the signal representing refrigerant pressure for developing a respective second digital, cut-out signal, respective means responsive to application of power to the respective controller ofr developing a respective third digital signal indicative of expiration of a distinct predetermined power-up delay period, which differs from the power-up delay periods of the other controllers, respective means responsive to a signal representing deenergization of a respective associated refrigerant compressor for developing of a respective fourth digital signal indicative of expiration of a respective predetermined down-time delay, and respective circuit means for developing a respective compressor-energizing control output in response to the contemporaneous presence of the respective third digital signal, the respective fourth digital signal and the respective first digital signal, and for developing a compressor-deenergizing control output in response to the contemporaneous presence of the respective third digital signal, the respective fourth digital signal and the respective second digital signal, wherein said respective circuit means for developing the compressor-energizing and compressor-deenergizing control outputs comprises logic circuit means, wherein said logic circuit means in each controller comprises a respective first AND gate having an output terminal, its two input terminals being coupled respectively to receive the respective third digital signal and the respective fourth digital signal and a respective second AND gate having an output terminal, its first input terminal being coupled to receive a digital signal from said output terminal of said respective first AND gate, including in each controller a respective source of clock pulses; a respective OR gate means coupled to receive the respective digital, cut-in signal and the respective digital, cut-out signal for producing a respective digital data output signal upon the occurrence of either the respective digital, cut-in signal or the respective digital, cut-out signal; a respective counter having an output terminal, a respective clock input terminal coupled to receive the clock pulses and an enabling input terminal coupled to receive the respective digital data output signal from said respective OR gate means; a respective further AND gate having an output terminal, one of its input terminals being coupled to receive the respective first digital, cut-in control signal and its second input terminal being coupled to said output terminal of said respective counter to receive a digital output signal therefrom which appears upon expiration of a respective predetermined count; and an additional respective AND gate having an output terminal, one of its input terminals being coupled to receive the respective second digital, cut-out control signal and its second input terminal being coupled to said output terminal of said respective counter to receive the digital output signal therefrom which appears upon expiration of a respective predetermined count.

5. The controlled refrigeration system according to claim 4, including in each controller a respective flip-flop circuit having one of its input terminals coupled to said output terminal of said respective further AND gate and responsive to a digital signal therefrom for setting said respective flip-flop circuit in a first condition, said respective flip-flop circuit having a second input terminal coupled to said output terminal of said respective additional AND gate and responsive to a respective digital signal therefrom for resetting said respective flip-flop circuit to a second condition, and wherein a second input terminal of said respective second AND gate is coupled to an output terminal of said respective flip-flop.

6. The controlled refrigeration system according to claim 5, wherein each said respective flip-flop circuit has a Q output terminal and a $\overline{Q}$ output terminal.

* * * * *